US011603853B2

(12) United States Patent
Sishtla

(10) Patent No.: US 11,603,853 B2
(45) Date of Patent: Mar. 14, 2023

(54) COMPRESSOR CONFIGURED TO CONTROL PRESSURE AGAINST MAGNETIC MOTOR THRUST BEARINGS

(71) Applicant: Carrier Corporation, Palm Beach Gardens, FL (US)

(72) Inventor: Vishnu M. Sishtla, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 32 days.

(21) Appl. No.: 16/973,356

(22) PCT Filed: Sep. 6, 2019

(86) PCT No.: PCT/US2019/049949

§ 371 (c)(1),
(2) Date: Dec. 8, 2020

(87) PCT Pub. No.: WO2020/055688

PCT Pub. Date: Mar. 19, 2020

(65) Prior Publication Data

US 2021/0254627 A1 Aug. 19, 2021

Related U.S. Application Data

(60) Provisional application No. 62/731,415, filed on Sep. 14, 2018.

(51) Int. Cl.
*F04D 29/051* (2006.01)
*F04D 29/058* (2006.01)
*F04D 17/10* (2006.01)

(52) U.S. Cl.
CPC ..... *F04D 29/0516* (2013.01); *F04D 29/0513* (2013.01); *F04D 17/10* (2013.01); *F04D 29/058* (2013.01)

(58) Field of Classification Search
CPC .. F04D 29/058; F04D 29/051; F04D 29/0516; F04D 17/10
See application file for complete search history.

(56) References Cited

U.S. PATENT DOCUMENTS 4,884,942 A * 12/1989 Pennink ..... F16C 39/04 415/107
4,997,340 A * 3/1991 Zinsmeyer ..... F04D 29/0516 415/105

(Continued)

FOREIGN PATENT DOCUMENTS

EP 3348839 A1 7/2018
GB 2462635 A 2/2010

(Continued)

OTHER PUBLICATIONS

Google; "Balance Line Leakage Rate"; Jul. 23, 2018; Retrived from the Internet URL:https://www.engtips. com/viewthread.cfm?qid=422986; 3 pages.

(Continued)

*Primary Examiner* — David E Sosnowski
*Assistant Examiner* — Jackson N Gillenwaters
(74) *Attorney, Agent, or Firm* — Cantor Colburn LLP

(57) ABSTRACT

A method of controlling, by a controller for a compressor (200), pressure at plurality of magnetic motor thrust bearings (360, 370) for a motor (280) disposed within a housing (220) for the compressor (200), wherein the motor (280) and an impeller (270) are disposed on a compressor shaft (260) within the housing, the method including: monitoring current at each of the plurality of magnetic motor thrust bearings (360, 370), controlling a flow regulator (400) in a bypass loop (380) for the impeller (270) to decrease flow through the bypass loop when a first current in a first of the plurality of magnetic motor thrust bearings (360, 370) exceeds a second current in a second of the plurality of magnetic motor thrust bearings (360, 370), and controlling the flow regulator (400) to increase flow through the bypass loop (380) when the second current exceeds the first current.

5 Claims, 4 Drawing Sheets

(56) References Cited

U.S. PATENT DOCUMENTS

| | | | | |
|---|---|---|---|---|
| 5,312,226 | A | 5/1994 | Miura et al. | |
| 9,938,983 | B2 | 4/2018 | Stalder et al. | |
| 2011/0286835 | A1 | 11/2011 | Van Der Span | |
| 2012/0219431 | A1* | 8/2012 | Sishtla | G05D 7/0664 417/53 |
| 2013/0115042 | A1* | 5/2013 | Mariotti | F04D 27/02 415/26 |
| 2017/0002825 | A1 | 1/2017 | Sorokes et al. | |
| 2017/0022999 | A1* | 1/2017 | Peer | F04D 29/083 |
| 2018/0073779 | A1* | 3/2018 | Johnson | F04D 27/004 |
| 2018/0195520 | A1* | 7/2018 | Oh | F04D 27/002 |

FOREIGN PATENT DOCUMENTS

| | | | |
|---|---|---|---|
| GB | 2493737 | A | 2/2013 |
| JP | H01187395 | A | 7/1989 |
| JP | H0378596 | B2 | 4/1991 |
| JP | H07259855 | A | 10/1995 |
| JP | 2755714 | B2 | 5/1998 |
| JP | 2002257080 | A | 9/2002 |
| WO | 9219869 | A1 | 11/1992 |
| WO | 9535447 | A1 | 12/1995 |
| WO | 2011076668 | A2 | 6/2011 |
| WO | 2011078680 | A1 | 6/2011 |

OTHER PUBLICATIONS

ISR/WO; International Application No. PCT/US2019/049949; dated Nov. 27, 2019; 16 pages.

* cited by examiner

COMPRESSOR CONFIGURED TO CONTROL PRESSURE AGAINST MAGNETIC MOTOR THRUST BEARINGS

CROSS REFERENCE TO RELATED APPLICATIONS

This is a US National Stage of Application No. PCT/US2019/049949, filed on Sep. 6, 2019, which claims the benefit of U.S. Provisional Application No. 62/731,415 filed Sep. 14, 2018, the disclosures of which are incorporated herein by reference.

BACKGROUND

Exemplary embodiments pertain to the art of compressors and more specifically a compressor configured to control pressure against magnetic motor thrust bearings.

In a centrifugal compressor, net aerodynamic thrust may be a difference of forces between an upstream end and a downstream end of an impeller. For a compressor with magnetic thrust bearings, it may be helpful to control thrust against the thrust bearings to avoid a thrust bearing overload.

BRIEF DESCRIPTION

Disclosed is a compressor including a first axis which is a compressor rotational center axis, the compressor including: a compressor housing including a first plurality of axially spaced ends including a first end and a second end, and a shaft disposed on the first axis, an impeller and a motor disposed on the shaft between the first plurality of axially spaced ends, wherein the impeller is proximate the first end and the motor is proximate the second end, and wherein the impeller includes an impeller rotor, the motor including a second plurality of axially spaced ends, including a third end and a fourth end, wherein the third end is proximate the impeller and the fourth end is proximate the second end, and the motor including a plurality of axially spaced motor thrust bearings, including a first thrust bearing and a second thrust bearing, wherein the first thrust bearing is proximate the third end and the second thrust bearing is proximate the fourth end, and an impeller bypass loop including a plurality of axially spaced fluid openings with a flow regulator therebetween, the axially spaced fluid openings including a first opening and a second opening, the first opening being fluidly disposed between the impeller rotor and the first end of the compressor and the second opening being fluidly disposed between the impeller rotor and the first thrust bearing, wherein the flow regulator is selectively controllable to affect a predetermined pressure distribution through the impeller, to thereby affect control of pressure acting on the plurality of thrust bearings.

In addition to one or more features and elements disclosed above or as an alternate the first end of the compressor is an upstream end, the second end of the compressor is a downstream end and the compressor further includes a balance piston proximate a downstream end of the impeller, wherein a balance piston chamber is defined fluidly between the balance piston and the impeller rotor, the second opening of the bypass loop is fluidly connected to the balance piston chamber, and selective controlling of the flow regulator effects control of pressure within the balance piston chamber.

In addition to one or more features and elements disclosed above or as an alternate responsive to selective controlling the flow regulator, pressure within the balance piston chamber is maintained within a predetermined range relative to suction pressure of the compressor housing.

In addition to one or more features and elements disclosed above or as an alternate the plurality of thrust bearings are magnetic thrust bearings, and the bypass loop is selectively controllable responsive to detected current at the plurality of thrust bearings, thereby affecting control of pressure at the plurality of thrust bearings.

In addition to one or more features and elements disclosed above or as an alternate responsive to controlling the flow regulator, pressure at the plurality of thrust bearings is maintained within a predetermined percentage of a threshold pressure limit for the plurality of thrust bearings.

In addition to one or more features and elements disclosed above or as an alternate the impeller includes a shrouded impeller housing that includes the impellor rotor and the balance piston, the balance piston chamber and the second opening of the bypass loop, and an inlet guide vane (IGV) housing is connected to the first end of the compressor at an upstream end of the impeller, wherein a structural clearance is provided between the shrouded impeller housing and the IGV housing, and the first opening of the bypass loop is fluidly connected to the structural clearance and thereby fluidly connected to the compressor upstream of the impeller.

In addition to one or more features and elements disclosed above or as an alternate the flow regulator is a valve and the compressor further includes a controller controlling the valve, wherein the controller is configured to: monitor a first current at the first thrust bearing and a second current at the second thrust bearing, close the valve when the first current exceeds the second current, and open the valve when the second current is greater than the first current.

In addition to one or more features and elements disclosed above or as an alternate when the valve is closed, the controller is further configured to monitor the first current until it is between a predetermined percentage of a threshold current limit for the plurality of thrust bearings before opening the valve, and when the valve is opened, the controller is further configured to monitor the second current until it is between the predetermined percentage of the threshold current limit for the plurality of thrust bearings before closing the valve, and wherein the threshold current limit for the plurality of thrust bearings corresponds to the threshold pressure limit for the plurality of thrust bearings.

In addition to one or more features and elements disclosed above or as an alternate the compressor further includes a motor rotor operationally connected to the shaft, axially between the plurality of thrust bearings, and a motor stator fixedly connected to the compressor housing and axially aligned with the motor rotor.

In addition to one or more features and elements disclosed above or as an alternate the compressor is a centrifugal single stage compressor.

Further disclosed is a method of controlling, by a controller for a compressor, pressure at plurality of magnetic motor thrust bearings for a motor disposed within a housing for the compressor, wherein the motor and an impeller are disposed on a compressor shaft within the housing, the method includes: monitoring current at each of the plurality of magnetic motor thrust bearings, controlling a flow regulator in a bypass loop for the impeller to decrease flow through the bypass loop when a first current in a first of the plurality of magnetic motor thrust bearings exceeds a second current in a second of the plurality of magnetic motor thrust bearings, and controlling the flow regulator to increase flow through the bypass loop when the second current exceeds the first current.

In addition to one or more features and elements disclosed above or as an alternate wherein the compressor includes: a first axis which is a compressor rotational center axis, the compressor housing including a first plurality of axially spaced ends including a first end and a second end, and the shaft disposed on the first axis, the impeller and the motor disposed on the shaft between the first plurality of axially spaced ends, wherein the impeller is proximate the first end and the motor is proximate the second end, and wherein the impeller includes an impeller rotor, the motor including a second plurality of axially spaced ends, including a third end and a fourth end, wherein the third end is proximate the impeller and the fourth end is proximate the second end, the motor including the plurality of motor thrust bearings, the plurality of motor thrust bearings being axially spaced and including a first thrust bearing and a second thrust bearing, wherein the first thrust bearing is proximate the third end and the second thrust bearing is proximate the fourth end, and the impeller bypass loop includes a plurality of axially spaced fluid openings with the flow regulator therebetween, the axially spaced fluid openings including a first opening and a second opening, the first opening being fluidly disposed between the impeller rotor and the first end of the compressor and the second opening being fluidly disposed between the impeller rotor and the first thrust bearing, wherein selectively controlling the flow regulator affects a predetermined pressure distribution through the impeller, to thereby affect control of pressure acting on the plurality of thrust bearings.

In addition to one or more features and elements disclosed above or as an alternate the first end of the compressor is an upstream end, the second end of the compressor is a downstream end and the compressor comprises a balance piston proximate a downstream end of the impeller, wherein a balance piston chamber is defined fluidly between the balance piston and the impeller rotor, the second opening of the bypass loop is fluidly connected to the balance piston chamber, and selectively controlling of the flow regulator affects control of pressure within a balance piston chamber.

In addition to one or more features and elements disclosed above or as an alternate responsive to selectively controlling the flow regulator, pressure within the balance piston chamber is maintained within a predetermined range relative to suction pressure of the compressor housing.

In addition to one or more features and elements disclosed above or as an alternate responsive to controlling the bypass loop, pressure at the plurality of thrust bearings is maintained within a predetermined percentage of a threshold pressure limit for the plurality of thrust bearings.

In addition to one or more features and elements disclosed above or as an alternate the flow regulator includes a valve fluidly controlling the bypass loop, wherein the controller: closes the valve when the first current exceeds the second current, and opens the valve when the second current is greater than the first current.

In addition to one or more features and elements disclosed above or as an alternate when the valve is closed, the controller monitors the first current until it is between a predetermined percentage of a threshold current limit for the plurality of thrust bearings before opening the valve, and when the valve is opened, the controller monitors the second current until it is between the predetermined percentage of the threshold current limit for the plurality of thrust bearings before closing the valve, and wherein the threshold current limit for the plurality of thrust bearings corresponds to the threshold pressure limit for the plurality of thrust bearings.

In addition to one or more features and elements disclosed above or as an alternate the impeller includes a shrouded impeller housing that includes the impellor rotor and the balance piston, the balance piston chamber and the second opening of the bypass loop, and an inlet guide vane (IGV) housing is connected within the first end of the compressor housing at an upstream end of the impeller, wherein a structural clearance is provided between the shrouded impeller housing and the IGV housing, and the first opening of the bypass loop is fluidly connected to the structural clearance and thereby fluidly connected to the compressor upstream end of the impeller.

Further disclosed is a method of configuring a compressor, wherein the compressor has one or more of the above disclosed features and elements.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
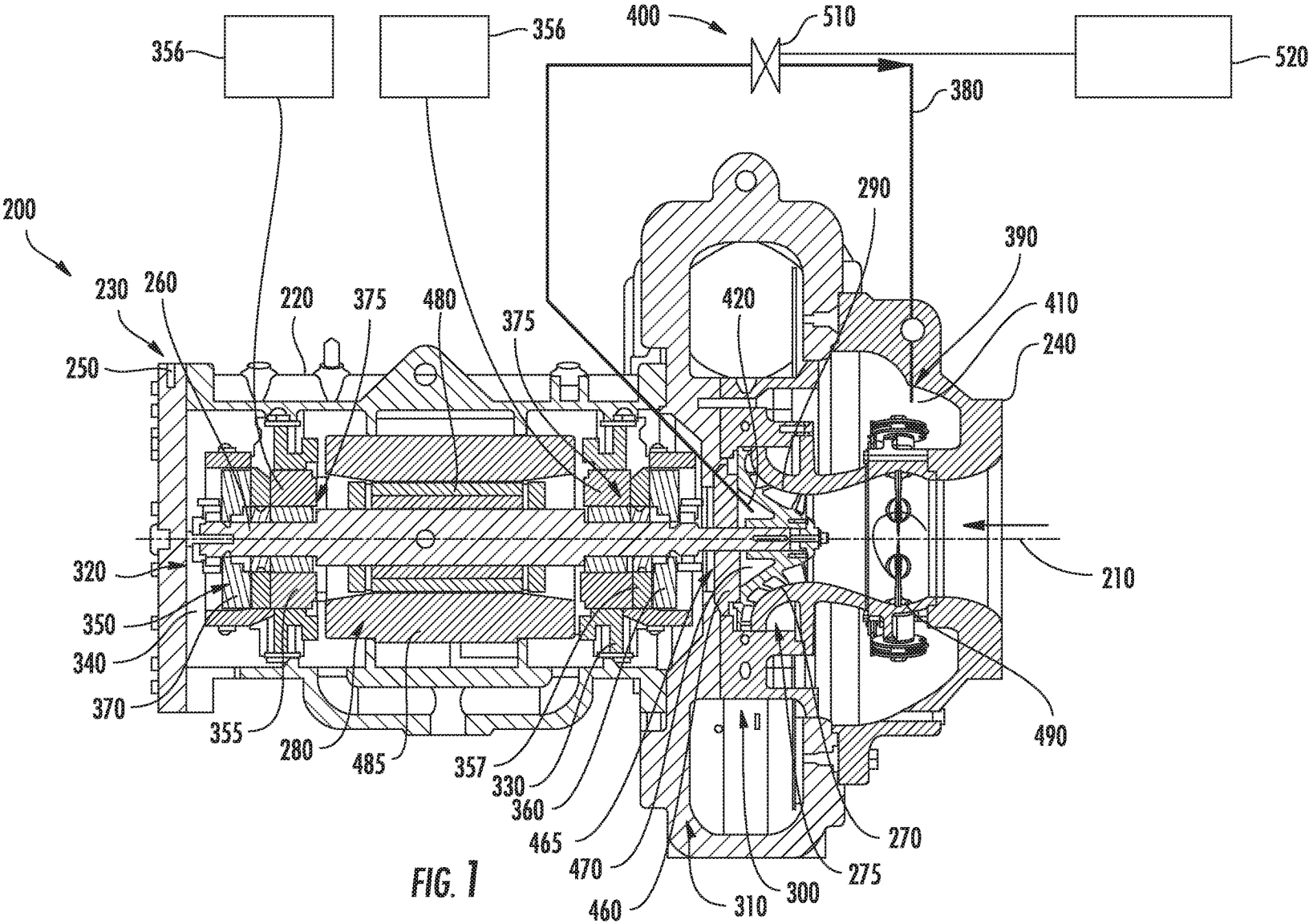
FIG. 1 illustrates features of a compressor according to an embodiment.

Turning to FIG. 1 a compressor generally referred to as 200 is disclosed including a first axis 210 which is a compressor rotational center axis. A compressor housing 220 includes a first plurality of axially spaced ends generally referred to as 230. The axially spaced ends 230 include a first end 240 and a second end 250, and may include a shaft 260 disposed on the first axis 210. An impeller 270 and a motor 280 may be disposed on the shaft 260 between the first plurality of axially spaced ends 230. The impeller 270 may be proximate the first end 240 and the motor 280 may be proximate the second end 250. The impeller 270 may include an impellor rotor 290. In addition, the impeller 270 may include a diffuser 300 and a collector/volute 310.

The motor 280 may including a second plurality of axially spaced ends generally referred to as 320, including a third end 330 and a fourth end 340. The third end 330 may be proximate the impeller 270, and the fourth end 340 may be proximate the second end 250 of the compressor housing 220. The motor 280 may include a plurality of axially spaced motor thrust bearings generally referred to as 350, including a first thrust bearing 360 and a second thrust bearing 370. The first thrust bearing 360 may be proximate the third end 330 of the motor 280 and the second thrust bearing 370 may be proximate the fourth end 340 of the motor 280. The motor 280 may also include a plurality of axially spaced radial magnetic bearings generally referred to as 375.

An impeller bypass loop 380 may be included which includes a plurality of axially spaced fluid openings generally referred to as 390 may include therebetween a flow regulator generally referred to as 400. The axially spaced fluid openings 390 may include a first opening 410 and a second opening 420. The first opening 410 may be fluidly disposed between the impeller rotor 290 and the first end 240 of the compressor 200. The second opening 420 may be fluidly disposed between the impeller rotor 290 and the first thrust bearing 360. The flow regulator 400 may be selectively controllable to affect a predetermined pressure distribution through the impeller 270. This configuration may effect control of pressure acting on the plurality of thrust bearings 350.

According to an embodiment the first end 240 of the compressor 200 may be an upstream end, and the second end 250 of the compressor 200 may be a downstream end. The compressor 200 may include a balance piston 460 proximate a downstream end of the impeller 270, where the downstream end 465 is generally referred to as 465. The balance piston 460 may have a diameter that is between eighty and ninety percent (80-90%) of an outside diameter of the impeller 270.

A balance piston chamber 470 may be defined fluidly between the balance piston 460 and the impeller rotor 290. The second opening 420 of the bypass loop 380 may be fluidly connected to the balance piston chamber 470. Selective controlling of the flow regulator 400 may affect control of pressure within the balance piston chamber 470. More specifically, responsive to selective controlling the flow regulator 400, pressure within the balance piston chamber 470 may remain within a predetermined range relative to suction pressure of the compressor housing 220. For example, selectively controlling the flow regulator 400 may maintain pressure in the balance piston chamber 470 that is one (1) PSI above suction pressure of the compressor housing 220. The impeller 270 may include a shrouded impeller housing 475 that may include the impellor rotor 290, the balance piston 460, the balance piston chamber 470 and the second opening 420 of the bypass loop 380.

The compressor 200 may include a motor rotor 480 operationally connected to the shaft 260, axially between the plurality of thrust bearings 350. The compressor 200 may include a motor stator 485 fixedly connected to the compressor housing 220 and axially aligned with the motor rotor 480. The illustrated compressor 200 may be a centrifugal single stage compressor 200, though other compressor configurations are within the scope of the disclosure.

According to an embodiment the plurality of thrust bearings 350 may be a respective plurality of magnetic thrust bearings. The magnetic thrust bearings 350 may have actuators generally referred to as 355 (for example, a coil embedded in a stator) that are excited by current from power amplifiers generally referred to as 356. The actuators 355 may provide a magnetic field to attract discs generally referred to as 357 mounted on the shaft 260. By adjusting the current through the thrust bearings 350, the shaft/disc assembly can be positioned at a given distance from the stationary actuators 355, thereby reducing pressure/forces against any one of the thrust bearings 350 induced by action of fluid through the impeller 270. That is, forces distributed between the thrust bearings 350 by the motor 380 may be maintained within a predetermined range, discussed in greater detail below. The distribution of the forces may become skewed when pressure in the motor 380 in the compressor 200 urges the motor 380 in an upstream or downstream direction, for example, relative to the stationary actuators. To control the pressure in the motor 380, the flow regulator 400 is operated to affect pressure in the balance piston chamber 470, as indicated above. When measured current in the thrust bearings 350 is balanced, the forces in the thrust bearings 350 are balanced as well.

Thus, the flow regulator 400 may be selectively controllable responsive to detected current at the plurality of thrust bearings 350, which is affected by pressure at the plurality of thrust bearings 350. More specifically, responsive to controlling the flow regulator 400, pressure at the plurality of thrust bearings 350 may be maintained within a predetermined percentage of a threshold pressure limit for the plurality of thrust bearings 350. In one embodiment the predetermined percentage range may be between fifty and seventy percent (50-70%) of the threshold pressure limit.

Figure 2:
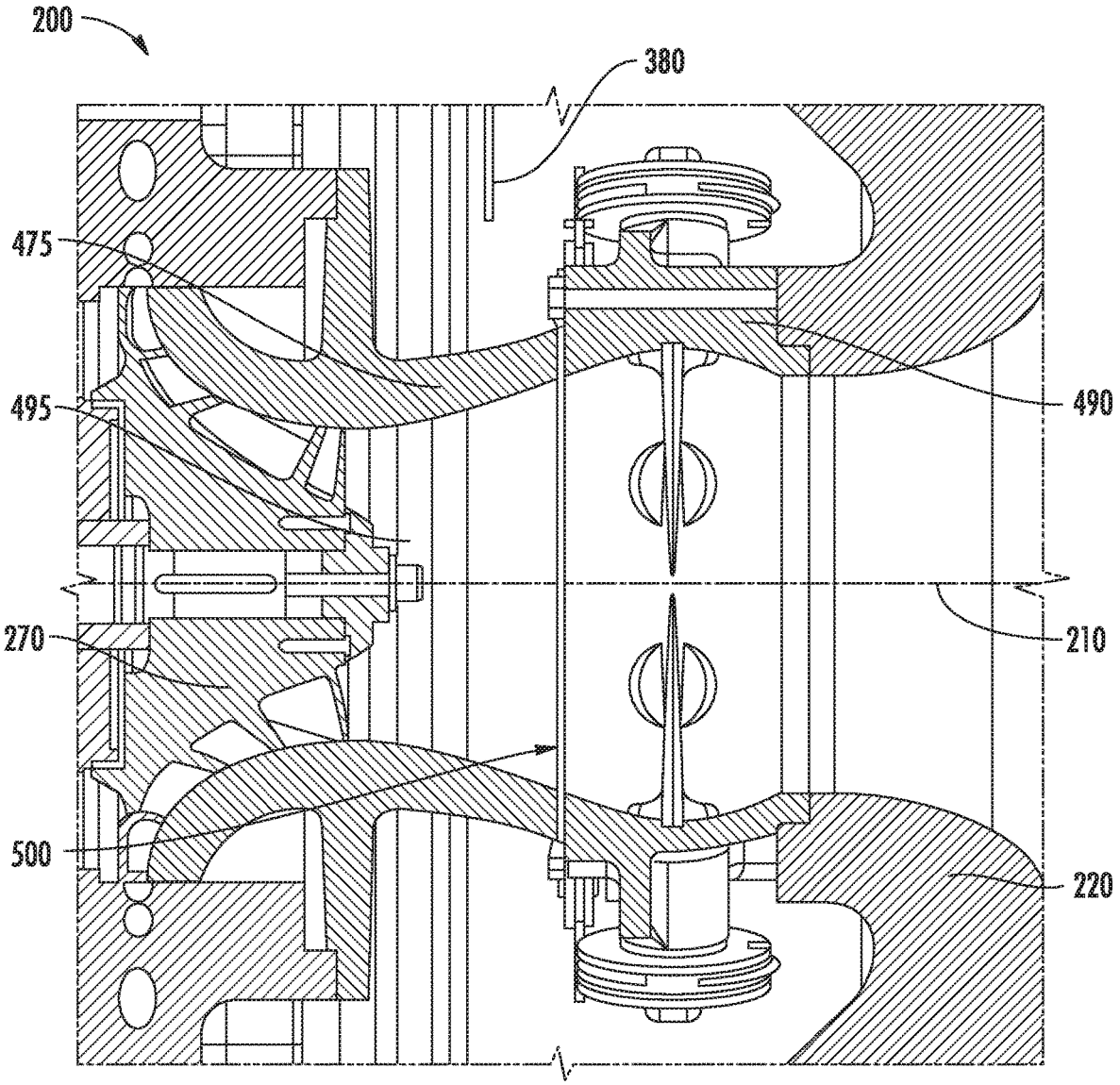
FIG. 2 illustrates additional features of a compressor according to an embodiment.

Turning to FIG. 2, an inlet guide vane (IGV) housing 490 may be connected to the first end 240 of the compressor housing 220, at an upstream end of the impeller 270, where the upstream end of the impeller 270 is generally referred to as 495. A structural clearance 500 may be provided between the shrouded impeller housing 275 and the IGV housing 490. The first opening 410 of the bypass loop 380 may be fluidly connected to the structural clearance 500 and thereby fluidly connected to the upstream end of the impeller 270.

Figure 3:
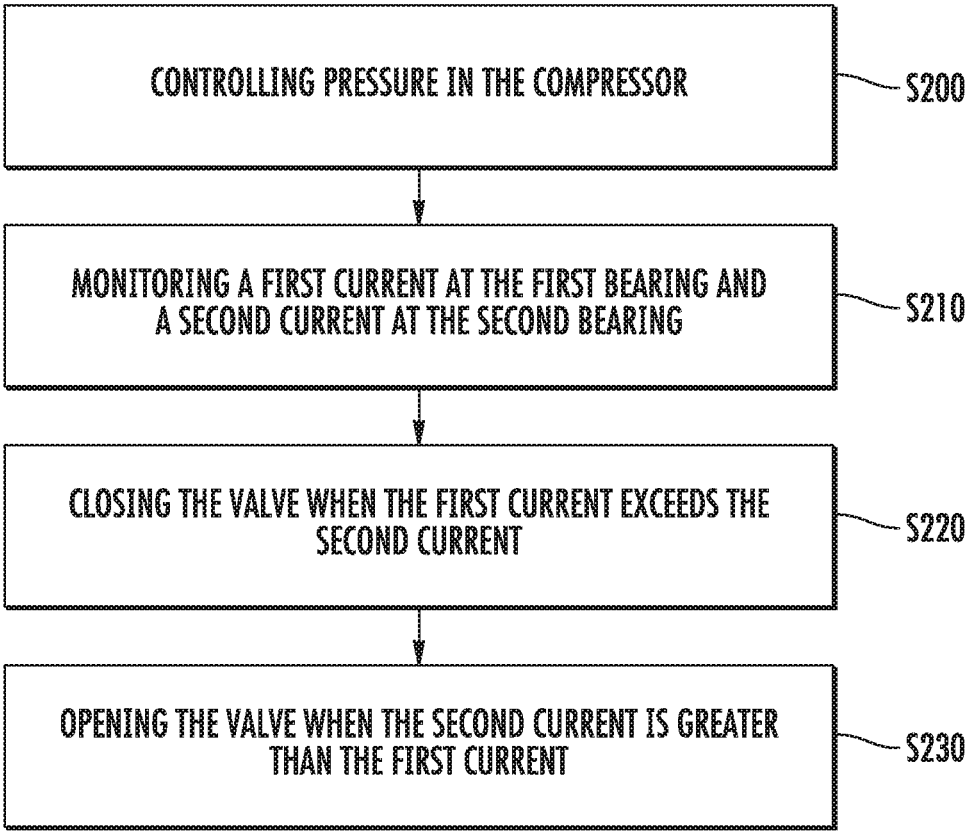
FIG. 3 illustrates a process of controlling pressure within a compressor according to an embodiment.
Figure 4:
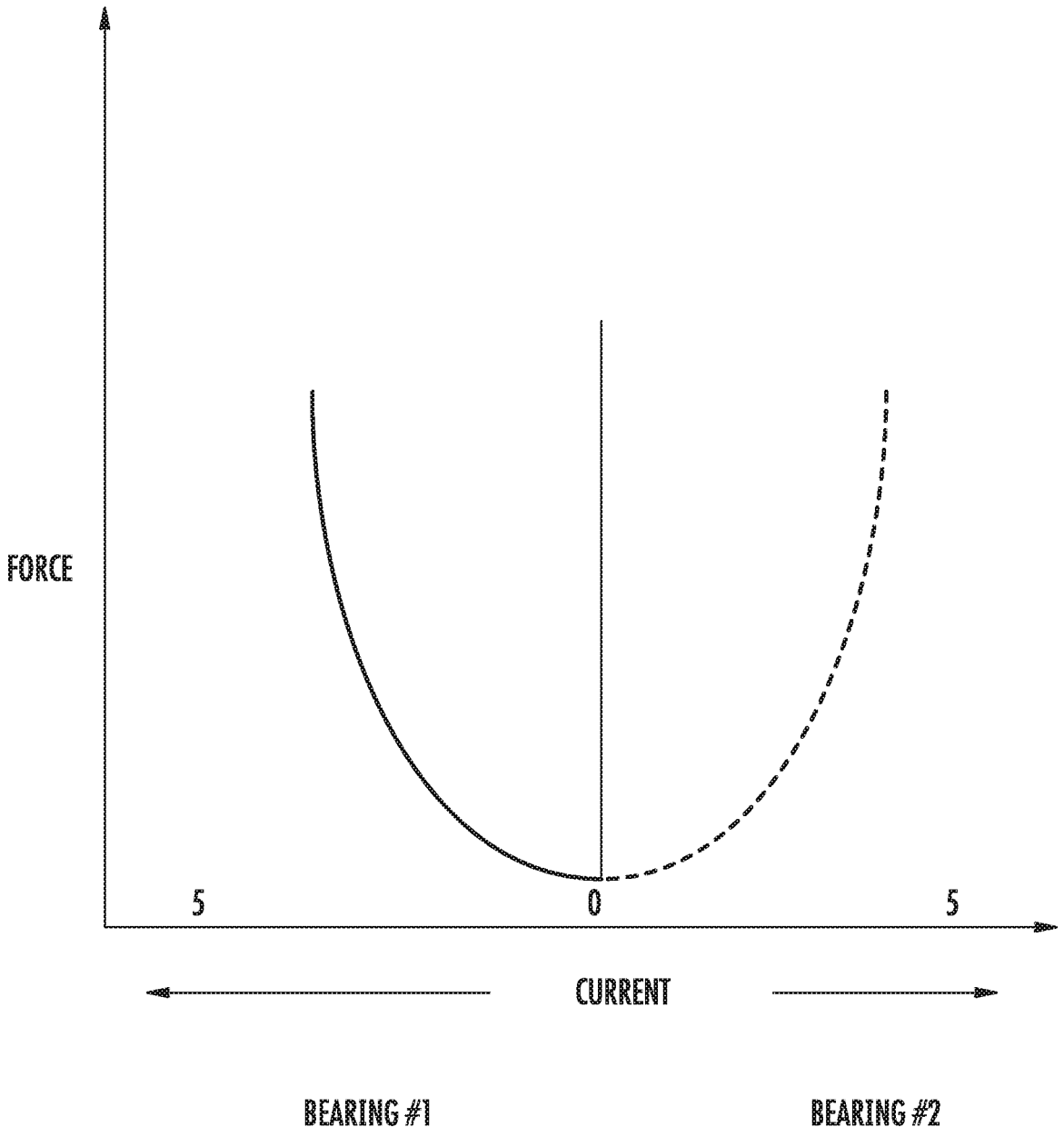
FIG. 4 is a graph of thrust bearing forces generated while executing the process of controlling pressure within a compressor according to an embodiment.

Turning back to FIG. 1, the flow regulator 400 may include a valve 510 fluidly controlling the bypass loop 380. A controller 520 illustrated schematically may control the valve 510. Turning to FIG. 3, a process S200 of controlling pressure in the compressor is illustrated. The process S200 may include the controller 520 performing the step S210 of monitoring a first current at the first thrust bearing 360 and a second current at the second thrust bearing 370. At step S220 the controller 520 may close the valve 450 when the first current exceeds the second current. At step S230 the controller 520 may open the valve 510 when the second current is greater than the first current. As illustrated in FIG. 4 (discussed in detail below) balancing the current provides balancing the forces on the thrust bearings 350.

In addition, when performing process S200, when the valve 510 is closed, the controller 520 may monitor the first current until it is between a predetermined percentage of a threshold current limit for the plurality of thrust bearings 350 before opening the valve 510. Similarly when the valve 510 is opened, the controller 520 may monitor the second current until it is between the predetermined percentage of the threshold current limit for the plurality of thrust bearings 350 before closing the valve 510. According to an embodiment the threshold current limit for the plurality of thrust bearings 350 may correspond to the threshold pressure limit for the plurality of thrust bearings 350.

Turning to FIG. 4, when the valve 450 is an open position, pressure in the balance piston chamber 470 may be, for example, one (1) PSI above suction housing pressure, and may be at a lowest relative value. At this time, net thrust, which is a function of pressure on the thrust bearings, will be in a downstream direction and the upstream thrust bearing will be active. When the valve 510 is in a close position, pressure in the balance piston chamber 470 may be, for example, one (1) psi above the pressure in the compressor housing 220 and will also be a lowest relative value.

As illustrated in the figure, capacity in the plurality of thrust bearings 350 increases with current. The balance piston 460 may be sized such that a force is directed downstream when the valve 510 is open. During operation, the valve 510 may be closed to bring the force between twenty and seventy percent (20-70%) of the capacity of the plurality of thrust bearings 350. The controller 460 controls the valve 510 to keep the thrust bearing force within the forty and fifty percent (40-50%) of a threshold value by adjusting the pressure downstream of the impeller 270. The controller 520 also controls the valve 510 to reduce the seal leakage by keeping the pressure relatively high.

Disclosed above is an impeller having a balance piston on a downstream side, and wherein the impeller may be vented to a predetermined lowest pressure in the compressor, downstream of the inlet guide vane (IGV). The control valve may control pressure between a predetermined minimum and maximum value. The control valve position may be varied to maintain a thrust bearing current within predetermined limits.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of controlling, by a controller for a compressor, pressure at plurality of magnetic motor thrust bearings for a motor disposed within a housing for the compressor, wherein the motor and an impeller are disposed on a compressor shaft within the housing, the method comprising:

monitoring current at each of the plurality of magnetic motor thrust bearings, controlling a flow regulator in a bypass loop for the impeller to decrease flow through the bypass loop when a first current in a first of the plurality of magnetic motor thrust bearings exceeds a second current in a second of the plurality of magnetic motor thrust bearings, and controlling the flow regulator to increase flow through the bypass loop when the second current exceeds the first current, wherein:

the compressor includes: a first axis which is a compressor rotational center axis, the compressor housing including a first plurality of axially spaced ends including a first end and a second end, and the shaft disposed on the first axis, the impeller and the motor disposed on the shaft between the first plurality of axially spaced ends, wherein the impeller is proximate the first end and the motor is proximate the second end, and wherein the impeller includes an impeller rotor, the motor including a second plurality of axially spaced ends, including a third end and a fourth end, wherein the third end is proximate the impeller and the fourth end is proximate the second end, the motor including the plurality of motor thrust bearings, the plurality of motor thrust bearings being axially spaced and including a first thrust bearing and a second thrust bearing, wherein the first thrust bearing is proximate the third end and the second thrust bearing is proximate the fourth end, and the impeller bypass loop comprises a plurality of axially spaced fluid openings with the flow regulator therebetween, the axially spaced fluid openings including a first opening and a second opening, the first opening being fluidly disposed between the impeller rotor and the first end of the compressor and the second opening being fluidly disposed between the impeller rotor and the first thrust bearing, wherein selectively controlling the flow regulator affects a predetermined pressure distribution through the impeller, to thereby affect control of pressure acting on the plurality of thrust bearings;

the first end of the compressor is an upstream end, the second end of the compressor is a downstream end and the compressor comprises a balance piston proximate a downstream end of the impeller, wherein a balance piston chamber is defined fluidly between the balance piston and the impeller rotor, the second opening of the bypass loop is fluidly connected to the balance piston chamber, and selectively controlling of the flow regulator affects control of pressure within a balance piston chamber; and the impeller comprises a shrouded impeller housing that includes the impeller rotor and the balance piston, the balance piston chamber and the second opening of the bypass loop, and an inlet guide vane (IGV) housing is connected within the first end of the compressor housing at an upstream end of the impeller, wherein a structural clearance is provided between the shrouded impeller housing and the IGV housing, and the first opening of the bypass loop is fluidly connected to the structural clearance and thereby fluidly connected to the upstream end of the impeller.

2. The method of claim 1 wherein responsive to selectively controlling the flow regulator, pressure within the balance piston chamber is maintained within a predetermined range relative to suction pressure of the compressor housing.

3. The method of claim 2 wherein responsive to controlling the bypass loop, pressure at the plurality of thrust bearings is maintained within a predetermined percentage of a threshold pressure limit for the plurality of thrust bearings.

4. The method of claim 3 wherein the flow regulator comprises a valve fluidly controlling the bypass loop, and wherein the controller:

closes the valve when the first current exceeds the second current, and opens the valve when the second current is greater than the first current.

5. The method of claim 4 wherein when the valve is closed, the controller monitors the first current until it is between a predetermined percentage of a threshold current limit for the plurality of thrust bearings before opening the valve, and when the valve is opened, the controller monitors the second current until it is between the predetermined percentage of the threshold current limit for the plurality of thrust bearings before closing the valve, and wherein the threshold current limit for the plurality of thrust bearings corresponds to the threshold pressure limit for the plurality of thrust bearings.

* * * * *